US006349772B2

(12) United States Patent
Mullen et al.

(10) Patent No.: US 6,349,772 B2
(45) Date of Patent: Feb. 26, 2002

(54) APPARATUS AND METHOD FOR HYDRAULICALLY ACTUATING A DOWNHOLE DEVICE FROM A REMOTE LOCATION

(75) Inventors: Bryon D. Mullen, Carrollton, TX (US); Tommy F. Grigsby, Houma, LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/184,844

(22) Filed: Nov. 2, 1998

(51) Int. Cl.[7] ..... E21B 33/12

(52) U.S. Cl. ..... 166/387; 166/65.1; 166/120; 166/374

(58) Field of Search ..... 166/65.1, 66.6, 166/120, 373, 374, 386, 387, 381, 126, 128, 122

(56) References Cited

U.S. PATENT DOCUMENTS

| | | | | |
|---|---|---|---|---|
| 3,456,723 A | * | 7/1969 | Current et al. | 166/120 |
| 4,237,979 A | * | 12/1980 | Weise | 166/120 X |
| 4,375,239 A | * | 3/1983 | Barrington et al. | 166/374 X |
| 4,432,417 A | * | 2/1984 | Bowyer | 166/120 |
| 4,493,374 A | * | 1/1985 | Magee, Jr. | 166/387 X |
| 4,531,581 A | * | 7/1985 | Pringle et al. | 166/120 |
| 4,535,843 A | * | 8/1985 | Jageler | 166/65.1 X |
| 4,649,993 A | * | 3/1987 | Going, III | 166/66.4 |
| 4,736,791 A | * | 4/1988 | Rorden et al. | 166/66.4 |
| 4,832,129 A | | 5/1989 | Sproul et al. | 166/387 |
| 4,834,175 A | | 5/1989 | Ross et al. | 166/120 |
| 4,856,595 A | * | 8/1989 | Upchurch | 166/374 |
| 4,917,187 A | | 4/1990 | Burns et al. | 166/297 |
| 5,050,681 A | * | 9/1991 | Skinner | 166/374 |
| 5,103,902 A | | 4/1992 | Ross et al. | 166/120 |
| 5,188,183 A | | 2/1993 | Hopmann et al. | 166/387 |
| 5,226,494 A | | 7/1993 | Rubbo et al. | 166/250 |
| 5,230,383 A | | 7/1993 | Pringle et al. | 166/66.4 |
| 5,273,112 A | * | 12/1993 | Schultz | 166/374 |
| 5,343,963 A | | 9/1994 | Bouldin et al. | 175/27 |
| 5,404,956 A | * | 4/1995 | Bohlen et al. | 166/387 |
| 5,490,564 A | * | 2/1996 | Schultz et al. | 166/374 |
| 5,492,173 A | | 2/1996 | Kilgore et al. | 166/66.4 |
| 5,558,153 A | | 9/1996 | Holcombe et al. | 166/373 |
| 5,579,283 A | | 11/1996 | Owens et al. | 367/83 |
| 5,615,741 A | * | 4/1997 | Coronado | 166/387 |
| 5,620,050 A | * | 4/1997 | Barbee | 166/120 X |
| 5,706,896 A | | 1/1998 | Tubel et al. | 166/313 |
| 5,785,120 A | * | 7/1998 | Smalley et al. | 166/55 |
| 5,810,082 A | * | 9/1998 | Jordan, Jr. | 166/120 |
| 5,893,413 A | * | 4/1999 | Lembcke et al. | 166/66.6 |
| 6,012,518 A | * | 1/2000 | Pringle et al. | 166/66.4 |

FOREIGN PATENT DOCUMENTS

| | | | |
|---|---|---|---|
| GB | 2315 507 A | 10/1997 | |
| WO | WO 98/55731 | 12/1998 | 23/6 |

* cited by examiner

*Primary Examiner*—Thomas B. Will
*Assistant Examiner*—Jong-Suk Lee
(74) *Attorney, Agent, or Firm*—William M. Imwalle; Lawrence R. Youst

(57) ABSTRACT

An apparatus (100) for actuating a hydraulically controllable device (102) disposed in a wellbore is disclosed. The apparatus (100) comprises a downhole hydraulic fluid source (134), a hydraulic fluid passageway (136) providing a communication path between the downhole hydraulic fluid source (134) and the hydraulically controllable device (102), a valve (144) disposed within the hydraulic fluid passageway (136) and a downhole electronics package (138). The downhole electronics package (138) receives a signal from the surface to operate the valve (144) from the closed position to the open position such that hydraulic pressure from the downhole hydraulic fluid source (134) actuates the hydraulically controllable device (102).

30 Claims, 7 Drawing Sheets

APPARATUS AND METHOD FOR HYDRAULICALLY ACTUATING A DOWNHOLE DEVICE FROM A REMOTE LOCATION

TECHNICAL FIELD OF THE INVENTION

This invention relates general to the field of actuating hydraulically controllable downhole tools and, in particular to, a remotely operated service tool having a self-contained hydraulic system for actuating hydraulically controllable downhole tools disposed within a wellbore.

BACKGROUND OF THE INVENTION

Without limiting the scope of the invention, its background is described in connection with setting a packer assembly in a wellbore that traverses a hydrocarbon formation, as an example.

Heretofore in this field, during the treatment and preparation of the wellbore for production, a packer assembly and sand control screen along with a service tool are run into the wellbore on a work string. The setting of the packer assembly against the casing is typically accomplished by manipulating the service tool. The success of such operations is dependent upon the ability to reciprocate the service tool vertically or to rotate it relative to the packer assembly. It has been found, however, that rotational displacement of the service tool in deviated wells is difficult to perform reliably because of frictional binding between the work string and the casing. Accordingly, vertical reciprocal movements have been preferred for setting and releasing packer assemblies in such instances.

During run-in, the packer assembly is mechanically locked in the unset condition by shear pins and anti-preset lugs that support the weight of the packer assembly along with the hang weight of other components such as a swivel shear sub, blank pipe, a sand control screen, a polished nipple, a tail screen, and a packer assembly. The shear pins and anti-preset lugs can safely support the combined weight of the downhole equipment. The shear pins are rated to yield to a preset shearing force to separate and release the service tool after the packer assembly has been set. It has been found, however, that in deviated or otherwise obstructed wellbores, shear pins designed to shear in response to vertical reciprocation may be damaged and the packer assembly may sometimes be inadvertently preset in response to frictional loading between the packer assembly and the wellbore in tight spots.

It has also been found that when operating in slanted or deviated wellbores, it is sometimes difficult to transmit sufficient force downhole from the surface to set mechanically actuated packer assemblies. The frictional engagement between the wellbore and the work string interferes with the transmission of the necessary mechanical force to set the packer assembly.

To overcome these difficulties, pressure may be applied to the fluid column within the work string to transmit the required packer assembly setting force. For example, the packer assembly may be set by dropping a ball through the work string into the service tool. Pressurized fluid is then pumped down the work string to shear the shear pins, thereby setting the packer assembly. During gravel packing or frac packing operations, it is desirable to remove the ball from the service tool. It has been found, however, that in slanted or deviated wellbores or in tapered work strings it is difficult to reverse the ball out of the work string. In addition, it has been found that the ball, in certain installation, may damage downhole equipment when it is run-in the service tools.

Therefore a need has arisen for an improved service tool for running and setting a packer assembly in a wellbore. A need has also arisen for an improved service tool for setting a packer assembly without the need for translational or rotational movement of the service tool with respect to the packer assembly and without the need for running a ball into the service tool. A need has further arisen for such a service tool that can set a packer assembly in a deviated or slanted wellbore.

SUMMARY OF THE INVENTION

The present invention disclosed herein comprises a service tool for hydraulically actuating a downhole device from a remote location. The service tool utilizes hydraulic pressure for actuating the downhole device without the need for translational or rotational movement of the service tool and without the need for running a ball into the service tool. The service tool of the present invention may be used in any wellbore including a deviated or slanted wellbore.

The service tool of the present invention comprises a downhole hydraulic fluid source, a hydraulic fluid passageway that provides a communication path between the downhole hydraulic fluid source and the hydraulically controllable device, a valve disposed within the hydraulic fluid passageway and a downhole electronics package. The downhole electronics package receives a signal from a surface installation to operate the valve from the closed position to the open position, thereby transmitting hydraulic pressure from the downhole hydraulic fluid source to the hydraulically controllable device and actuating the hydraulically controllable device.

The hydraulic fluid source includes a housing and a sleeve that define a hydraulic fluid chamber therebetween having hydraulic fluid contained therein. The sleeve is slidably disposed about the housing and has first and second positions relative to the housing. The sleeve is operated from the first position to the second position, responsive to hydrostatic pressure, once the valve is operated from the closed position to the open position. The sleeve and the housing also define an atmospheric air chamber therebetween having air contained therein.

The downhole electronics package includes a transducer that receives the signal from a surface installation. The transducer may be selected from a variety of transducers that are suitable for downhole reception of a signal including, but not limited to, an acoustic transducer, a pressure pulse transducer, an electromagnetic transducer and the like. The transducer receives the signal and relays the signal to the controller of the valve. The downhole electronics package also includes a battery pack to provide a source of electrical power.

The method for actuating a downhole device of the present invention involves sending a signal to a downhole electronics package, transmitting hydraulic pressure from a downhole hydraulic source to the downhole device in response to the signal and actuating the downhole device in response to the hydraulic pressure. The method may also include operating a valve to establish a communication path between the downhole hydraulic source and the downhole device and utilizing hydrostatic pressure to transmit the hydraulic fluid from the downhole hydraulic source to the downhole device.

In the method of the present invention, the signal may be sent to a downhole electronics package from a surface installation. The signal may be an acoustic signal, a pressure pulse signal, an electromagnetic signal or other suitable signal the may be received downhole.

The actuation of the downhole device may further include the setting a downhole device such as a packer assembly, or the manipulating a downhole device such as a sliding sleeve, a fluid control device or a well control device. Additionally, the actuation of the downhole device may be achieved by axially shifting a component of the downhole device or rotatably operating a component of the downhole device.

BRIEF DESCRIPTION OF THE DRAWINGS

For a more complete understanding of the features and advantages of the present invention, references now made to the detailed description of the invention along with the accompanying figures in which corresponding numerals in the different figures refer to corresponding parts and in which.

DETAILED DESCRIPTION OF THE INVENTION

While the making and using of various embodiments of the present invention is discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
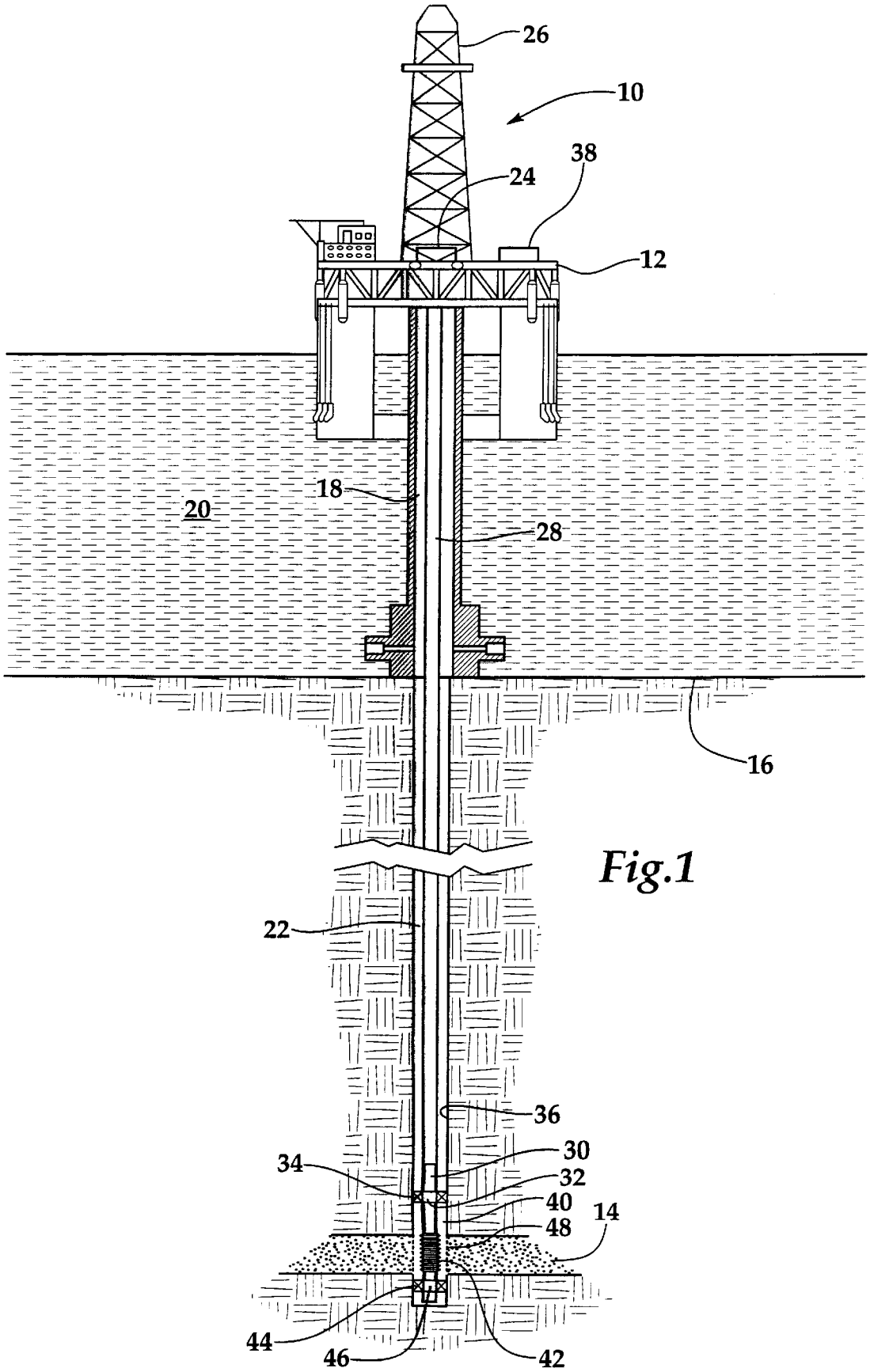
FIG. 1 is a schematic illustration of an offshore oil and gas platform operating a service tool of the present invention.

Referring to FIG. 1, a service tool operably coupled to a packer assembly in use with an offshore oil and gas platform is schematically illustrated and generally designated 10. A semi-submersible platform 12 is centered over a submerged oil and gas formation 14 located below sea floor 16. A well 18 extends through the sea 20 penetrating sea floor 16 to form wellbore 22 which traverses various earth strata.

Platform 12 has hoisting apparatus 24 and a derrick 26 for raising and lowering pipe strings such as work string 28. Attached to the lower end of work string 28 is service tool 30 that is landed within the bore of packer assembly 32. As will be explained in greater detail below, packer assembly 32 has mechanically actuated slips which set expandable annular seal elements 34 against the inside bore of tubular well casing 36. Packer assembly 32 is actuated by hydraulic fluid from service tool 30. Service tool 30 is remotely operated by a signal generated at surface installation 38. After setting packer assembly 32, service tool 30 remains sealed against the inner bore of packer assembly 32 to, for example, allow a gravel laden slurry to be pumped through the work string 28 and the service tool 30 into annulus 40 between the casing 36 and a sand control screen 42. A seal is provided above and below formation 14 by expanded annular seal elements 34 carried on packer assembly 32 and expanded annular seal elements 44 carried on packer assembly 46. During the gravel pack operation, the annulus 40 is filled with slurry, and the slurry is pumped through perforations 48 formed in the sidewall of the well casing 36 into the surrounding formation 14.

Even though FIG. 1 depicts a cased vertical well, it should be noted by one skilled in the art that the service tool of the present invention is equally well-suited for operation in uncased wells, deviated wells, inclined wells or horizontal wells.

Figure 2A:
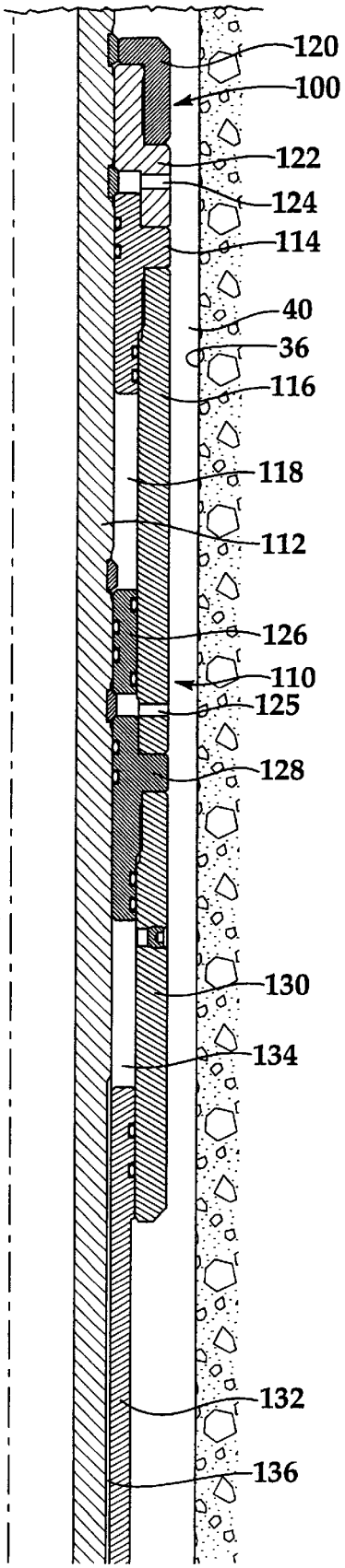
FIGS. 2A–2F are quarter-section views of a service tool of the present invention in the run-in position that is attached to a packer assembly in the unset position.
Figure 2B:
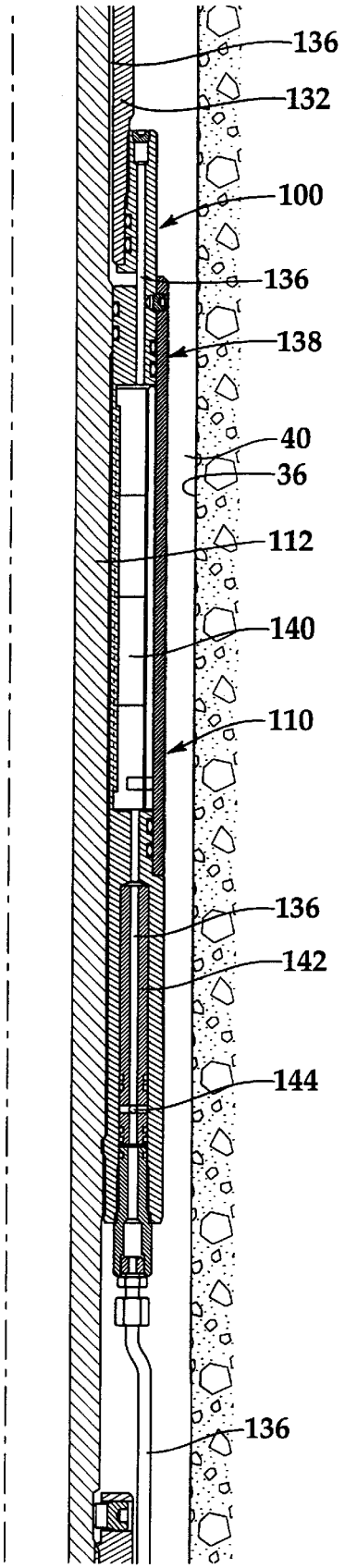
Figure 2C:
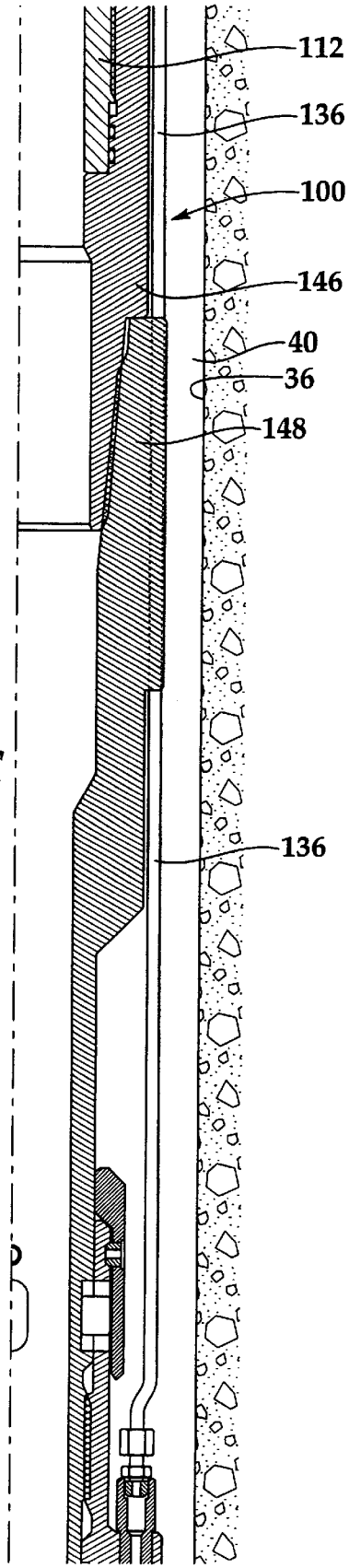
Figure 3C:
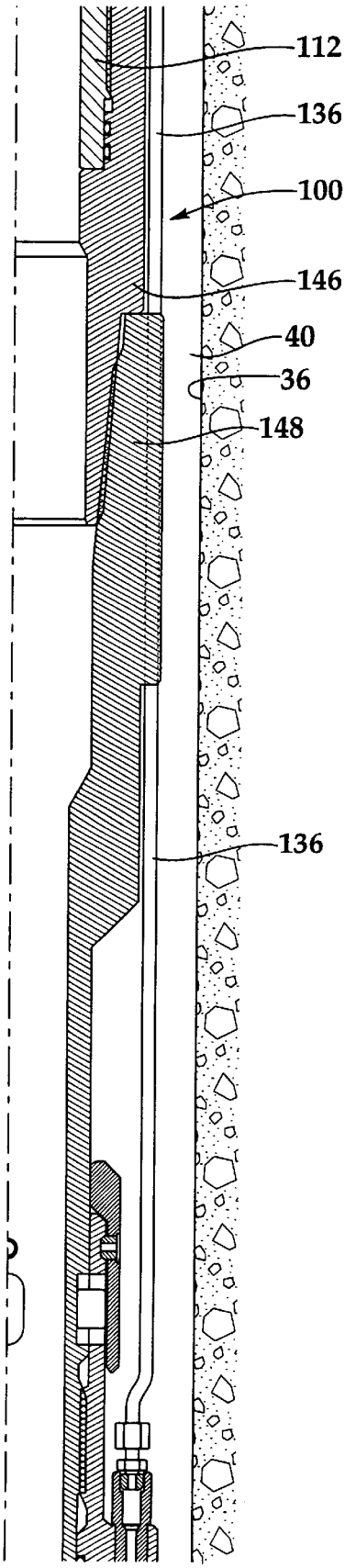
Figure 2D:
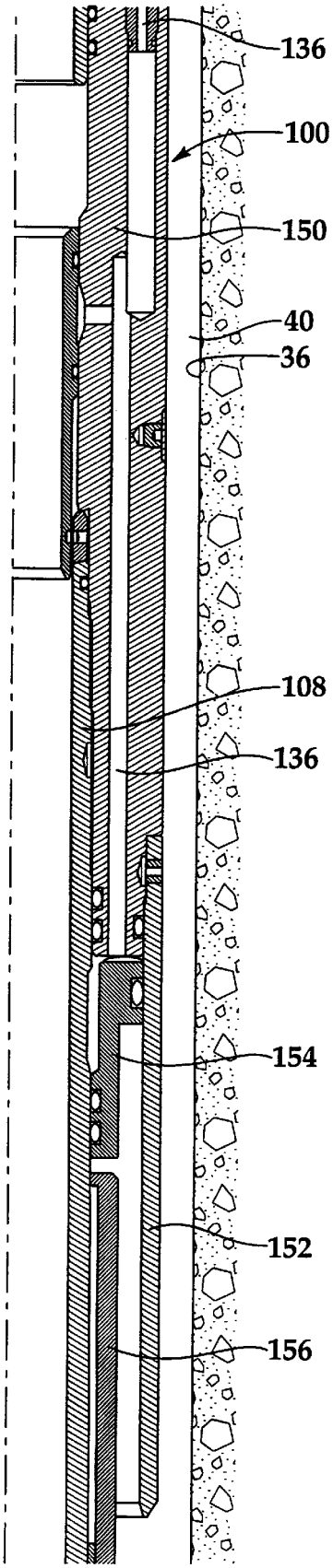
Figure 2E:
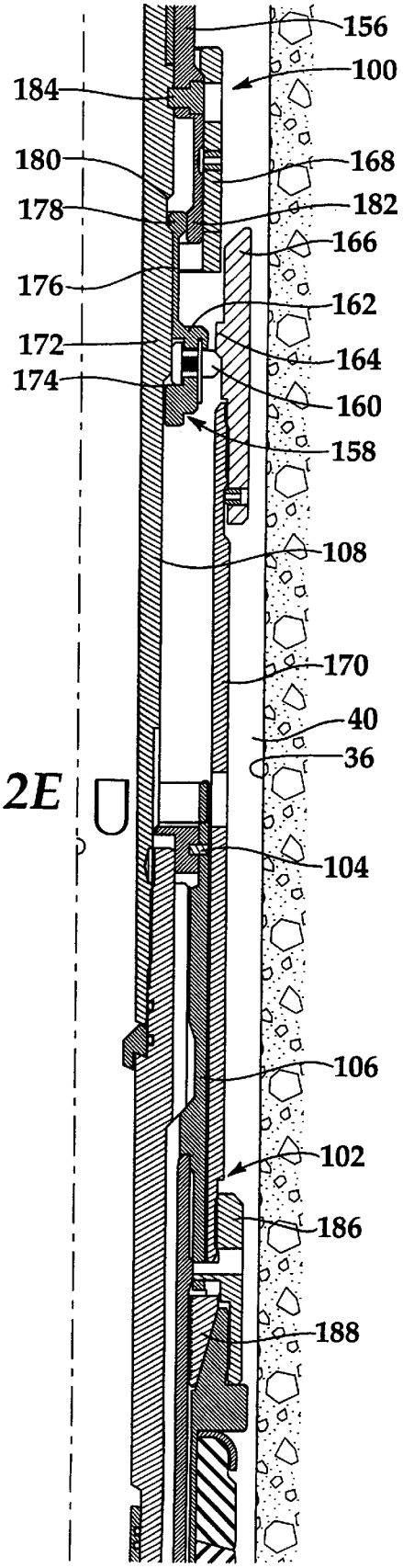

Referring now to FIGS. 2A–2F, the service tool 100 of the present invention is rigidly locked onto packer assembly 102 during the initial run-in operation. According to this arrangement, the service tool 100, packer assembly 102 and all the equipment which is hung off of packer assembly 102 are run-in through the bore of casing 36 as an assembled unit. As best seen in FIG. 2E, a group of separation shear pins 104 having appropriate shear strength for supporting the packer assembly hang weight connect the packer assembly mandrel 106 to the service tool mandrel 108. The shear pins 104 are rated to safely support the combined weight of the downhole equipment, and are rated to yield to a preset shearing force to separate and release the service tool 100 from the packer assembly 102 after setting packer assembly 102.

Referring specifically to FIG. 2A, service tool 100 includes a hydraulic power unit 110. Hydraulic power unit 110 has an inner mandrel 112. Disposed about inner mandrel 112 is an air chamber piston 114 and an air chamber sleeve 116. Disposed between air chamber sleeve 116 and inner mandrel 112 is air chamber 118. Also disposed about inner mandrel 112 is a retainer member 120. Between retainer member 120 and air chamber piston 114 is an annular housing extension 122 having a port 124 therein. Air chamber sleeve 116 includes a port 125. Disposed about inner mandrel 112 is a retainer member 126. Atmospheric air may be contained within air chamber 118.

Below air chamber 118 and disposed about inner mandrel 112 is a hydraulic piston 128, a hydraulic sleeve 130 and a retainer member 132. Disposed between hydraulic sleeve 130 and inner mandrel 112 is a hydraulic fluid chamber 134 that contains hydraulic fluid. Disposed between retainer member 132 and inner mandrel 112 is a hydraulic fluid passageway 136.

Referring now to FIG. 2B, a control assembly 138 is disposed about inner mandrel 112. Control assembly 138 includes a battery pack 140 that provides electrical power to a transducer 142. Transducer 142 receives signals from surface installation 38 of FIG. 1 in the form of acoustic signals, electromagnetic signals, pressure pulse signals or other suitable signals that may transmit information from a remote location to transducer 142, such methods being well-known to those skilled in the art. Disposed within hydraulic fluid passageway 136 is a valve 144 that may be operated responsive to signals received by transducer 142.

Referring now to FIGS. 2C–2D, at the lower end of inner mandrel 112 is a connector member 146 that is threadably attached to a connector member 148. Threadably and sealably connected to connector member 148 is outer housing 150. Outer housing 150 includes the lower end of hydraulic fluid passageway 136. The upper portion of service tool mandrel 108 extends into outer housing 150. Outer housing 150 includes an outer housing extension 152. Disposed between outer housing extension 152 and service tool mandrel 108 is operating piston 154 which includes an operating piston extension 156. The relative movement of operating piston extension 156 and service tool mandrel 108 is prevented by shear pins 184 as best seen in FIG. 2E.

Below operating piston extension 156 is a transfer support assembly 158 that includes a group of anti-preset lugs 160 carried by a collet 162. Anti-preset lugs 160 are engaged against the lower shoulder of annular flange 164 which is formed on a tube guide extension 166. Setting sleeve extension 166 is aligned to receive sleeve 168. The hang weight of packer assembly 102 is transmitted through a setting sleeve 170 through the anti-preset lugs 160 and collet 162 to service tool mandrel 108. As such, packer assembly 102 and the equipment attached thereto are supported by the work string 28 through service tool mandrel 108, anti-preset lugs 160 and setting sleeve 170. This configuration results in a decoupling of handling forces which arise during the run-in procedure with respect to shear pins 104.

The service tool 100 is provided with a locking flange 172 which is engaged by a shoulder portion 174 of the collet 160. Collet 160 is held in its position shown in FIG. 2E by its finger portions 176 having their head portions 178 received in a detent groove 180 formed in the service tool mandrel 108 above the upper shoulder of the locking flange 172. The head portion 178 is engaged and prevented from deflecting by a piston shoulder 182 which forms a part of operating piston extension 156.

Figure 2F:
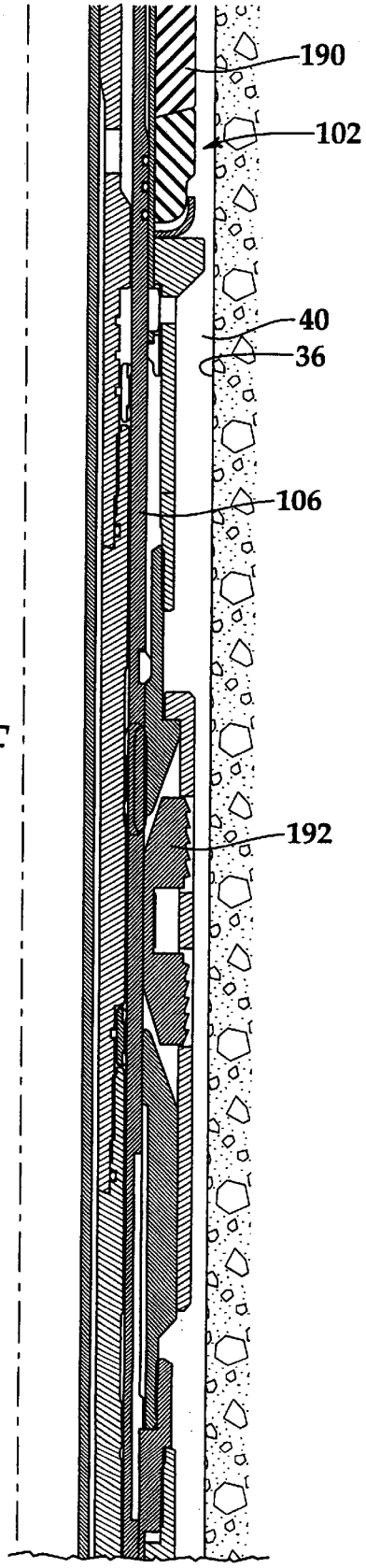

As best seen in FIGS. 2E–2F, connected to the lower end of setting sleeve 170 is connector sub 186. Disposed between connector sub 186 and packer assembly mandrel 106 is a slip ring assembly 188 that is used to retain the seal element 190 and casing slips 192 of packer assembly 102 in the set position.

It should be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. It is to be understood that the downhole components described herein, for example, service tool 100, may be operated in vertical, horizontal, inverted or inclined orientations without deviating from the principles of the present invention.

Figure 3A:
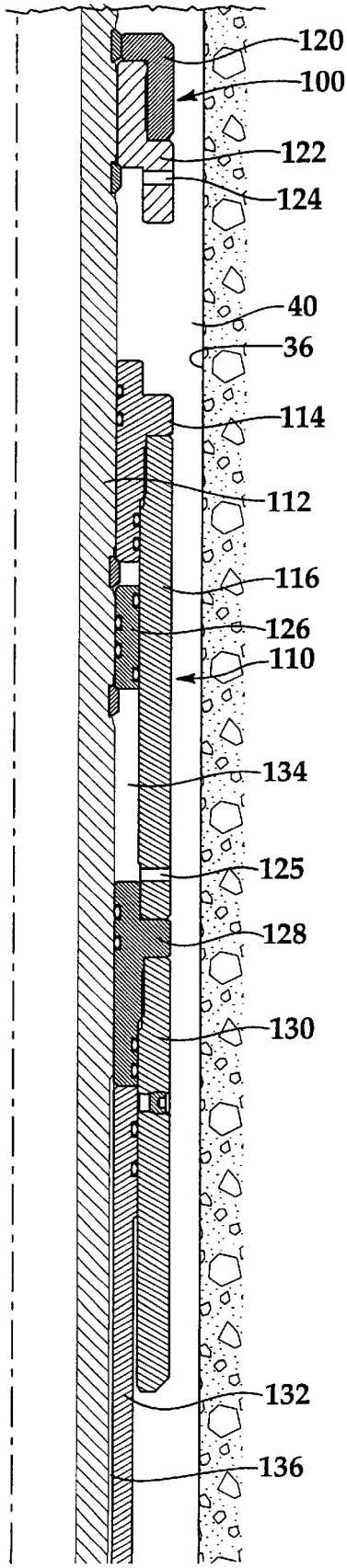
FIGS. 3A–3F are quarter-section views of a service tool of the present invention after operation of the service tool and actuation of a packer assembly to the set position.
Figure 3B:
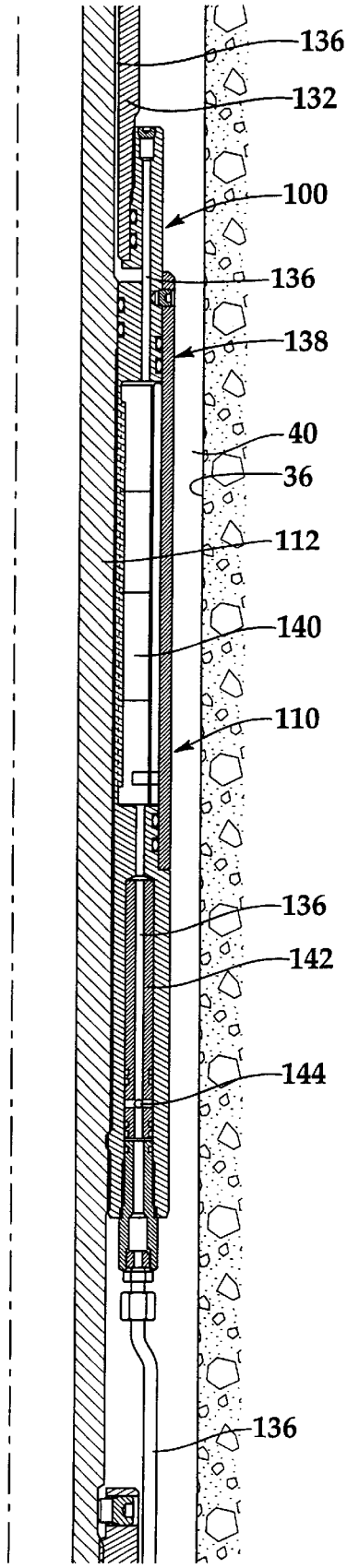
Figure 3D:
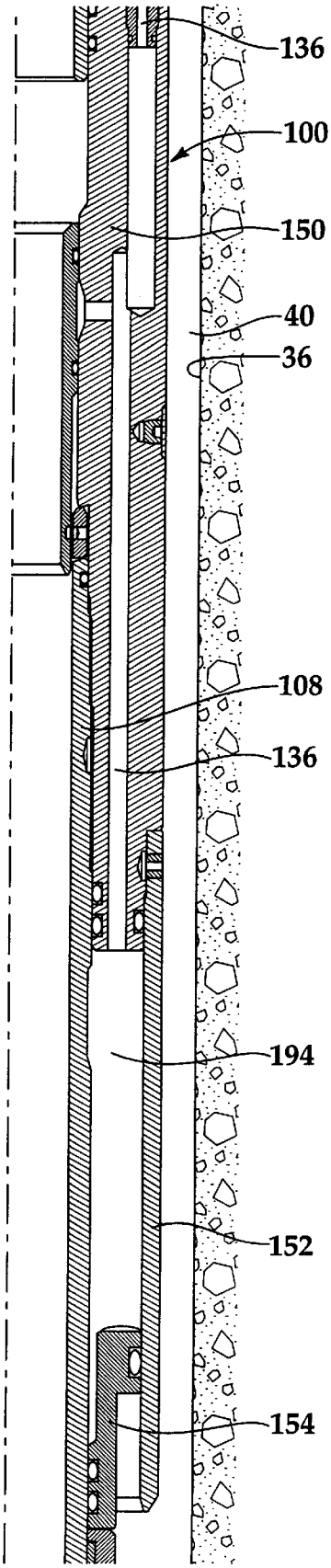

The operation of service tool 100 and packer assembly 102 will now be described with reference to FIGS. 3A–3F, wherein service tool 100 and packer assembly 102 are shown following their operation. Transducer 42 receives a signal from surface installation 38 to initiate the actuation of a hydraulically controllable device such as packer assembly 102. Transducer 142 converts the signal to an electrical signal that is used to open valve 144, as best seen in FIG. 3B. Once valve 144 is open, the hydrostatic pressure within annulus 40 downwardly biases air chamber piston 114, air chamber sleeve 116, hydraulic piston 128 and hydraulic sleeve 130, as best seen in FIG. 3A. The air in air chamber 118 upwardly biases air chamber piston 114 to dampen the downward bias force of the hydraulic pressure, thereby reducing the downward velocity of the chamber piston 114, air chamber 116, hydraulic piston 128 and hydraulic sleeve 130. The hydraulic fluid in hydraulic chamber 134 may now pass through hydraulic fluid passageway 136 and valve 144. As best seen in FIG. 3D, the hydraulic fluid downwardly biases operating piston 154 including operating piston extension 156 and accumulates in hydraulic fluid reservoir 194.

Figure 3E:
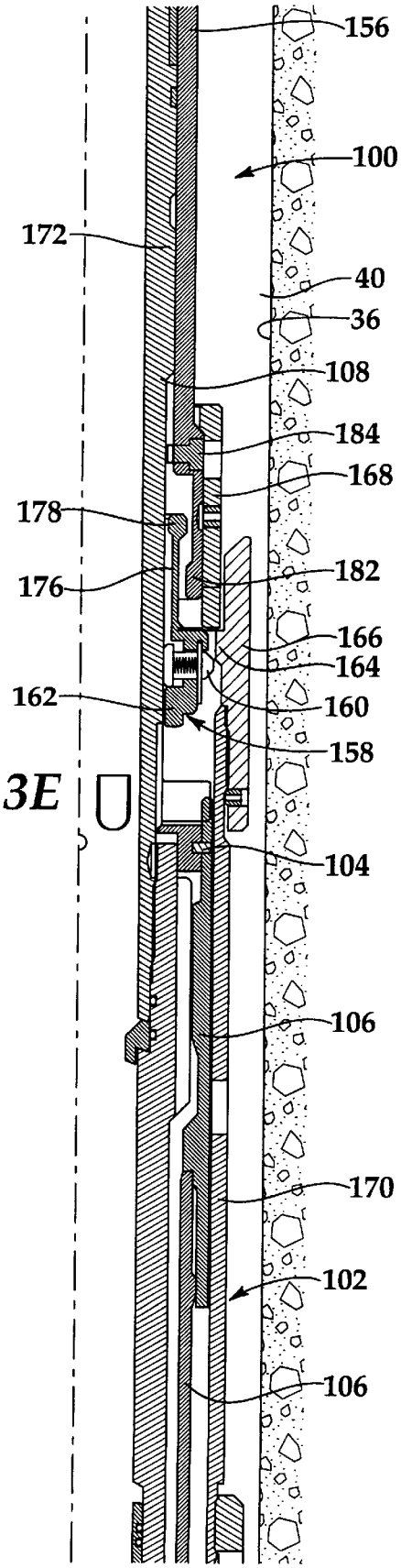

Operating piston 154 is guided for movement along the external surface of the service tool mandrel 108 by outer housing extension 152. Once the hydraulic pressure is increased to a level great enough to cause shear pins 184 to shear, operating piston 154 is permitted to drive sleeve 168 downwardly against annular flange 164 of setting sleeve extension 166 as best seen in FIG. 3E. Collet 162 remains in place as operating piston 154 is driven downwardly until shoulder 182 clears head portions 178, thereby permitting it to deflect and also permitting transfer support assembly 158 to move downwardly along the locking flange 172. Thereafter, the spring loaded anti-preset lugs 160 retract radially inwardly. When this occurs, the hang weight of packer assembly 102 is transferred from anti-preset lugs 160 to shear pins 104.

Figure 3F:
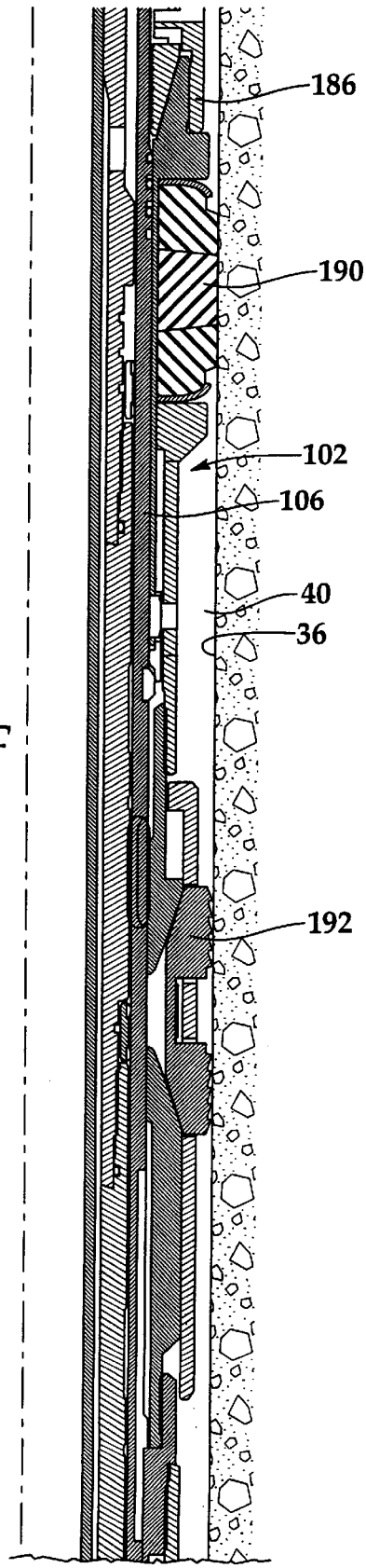

Setting sleeve 170 is movable relative to packer assembly mandrel 106. Setting sleeve 170 is moved downwardly relative to packer assembly mandrel 106 in response to continued extension of operating piston 154. As operating piston 154 nears the limit of its extension along service tool mandrel 108, slips 192 are engaged and set against the inside bore of the well casing 36 as best seen in FIG. 3F.

Because the packer assembly mandrel 106 is anchored onto the service tool mandrel 108 by separation shear pins 104, setting sleeve 170 continues its downward movement relative to packer assembly mandrel 106. Once the desired slip setting pressure has been achieved and packer assembly 102 is securely anchored in place, service tool 100 can then be released from the packer assembly 102 by pulling the work string 28 upward. Additionally, prior to pulling work string 28 and service tool 100 out of wellbore 22 a formation conditioning or sand control operation may be preformed such as a high rate water pack, a frac pack, a gravel pack or the like.

According to the foregoing arrangement, service tool 100 attaches to packer assembly 102 in such a way that packer assembly 102 can be run, set and service tool 100 released from packer assembly 102 without any kind of rotation of service tool 100. The hang load is transferred from the separation shear pins 104 by the anti-preset lugs 160. Accordingly, any weight hanging below packer assembly 102 is not applied to separation shear pins 104 during the run-in procedure. Anti-preset lugs 106 are locked in the supporting position during transit by the set of shear pins 184 which lock operating piston extension 156 to service tool mandrel 108. Movement of operating piston 154 in response to the transfer of hydraulic fluid from hydraulic fluid chamber 134 through hydraulic fluid passageway 136 into hydraulic fluid reservoir 194 causes pins 184 to shear, such that collet 162, which holds anti-preset lugs 160 in place, becomes unsupported, thereby permitting collet 162 to carry anti-preset lugs 160 to a new position which permits anti-preset lugs 160 to retract, thereby transferring the hang weight to separation shear pins 104.

Continued movement of operating piston 154 downwardly brings sleeve 168 of service tool 100 to bear against setting sleeve extension 166 of packer assembly 102, thereby moving the outer parts of packer assembly 102 relative to packer assembly mandrel 106, and in doing so, expanding seal elements 190 and setting slips 192. After slips 192 have been securely set and annular seal elements 190 have been expanded, separation pins 104 are sheared. Movement of service tool 100 is then possible by straight up or down movement of work string 28 at the surface.

As a result, the unique service tool 100 of the present invention provides for remote actuation of a hydraulically controllable device such as packer assembly 102. Remote actuation is achieved utilizing surface installation 38 to generate a signal that is received by transducer 136 of hydraulic power unit 110. This allows for the highly reliable use of hydraulic fluid transfer to operate the hydraulically controllable device without axial or rotational reciprocation of service tool 100 and without the need to drop a ball down through work string 22 or run a hydraulic line from the surface.

Even though the service tool of the present invention has been described with reference to operating packer assembly 102 using hydraulic power unit 110 to axially shift operating piston 154, among other components, it should be noted by one skilled in the art that the service tool of the present invention is equally well-suited for actuating other hydraulically controllable downhole devices. For example, the service tool of the present invention may be used to rotatably operate components in a downhole device in order to achieve a desired result. Similarly, the service tool of the present invention may be used to hydraulically initiate the actuation of a valve from either the closed position to the open position or the open position to the closed position, to hydraulically initiate the shifting of a sliding sleeve or to hydraulically initiate the actuation of similarly operated downhole devices.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for actuating a downhole device comprising the steps of:

sending a signal to a downhole electronics package;

establishing a communication path between a self-contained downhole hydraulic fluid source and the downhole device in response to the signal;

transmitting a hydraulic from the self-contained downhole hydraulic fluid source to the downhole device through the communication path by utilizing hydrostatic pressure from an annulus surrounding the downhole device to urge the hydraulic fluid from the self-contained downhole hydraulic fluid source to the downhole device; and actuating the downhole device in response to the hydraulic fluid.

2. The method as recited in claim 1 wherein the step of transmitting the hydraulic fluid further comprises the step of operating a valve from a closed position to an open position.

3. The method as recited in claim 1 wherein the step of sending the signal to the downhole electronics package further comprises sending a signal from a surface installation.

4. The method as recited in claim 1 wherein the step of sending the signal to the downhole electronics package further comprises sending an acoustic signal.

5. The method as recited in claim 1 wherein the step of sending the signal to the downhole electronics package further comprises sending a pressure pulse signal.

6. The method as recited in claim 1 wherein the step of sending the signal to the downhole electronics package further comprises sending an electromagnetic signal.

7. The method as recited in claim 1 wherein the step of actuating the downhole device further comprises setting the downhole device.

8. The method as recited in claim 7 wherein the downhole device is a packer assembly.

9. The method as recited in claim 1 wherein the step of actuating the downhole device further comprises manipulating the downhole device.

10. A method for hydraulically actuating a downhole device from a remote location comprising the steps of:

sending a signal from a surface installation to a downhole electronics package;

establishing a communication path between a self-contained downhole hydraulic fluid source and the downhole device in response to the signal; and urging hydraulic fluid from the self-contained downhole hydraulic fluid source to the downhole device in response to hydrostatic pressure from an annulus surrounding the downhole device and simultaneously compressing a compressible fluid in a compressible fluid chamber to dampen the response to the hydrostatic pressure, thereby hydraulically actuating the downhole device.

11. The method as recited in claim 10 wherein the step of sending the signal from the surface installation to the downhole electronics package further comprises sending an acoustic signal.

12. The method as recited in claim 10 wherein the step of sending the signal from the surface installation to the downhole electronics package further comprises sending a pressure pulse signal.

13. The method as recited in claim 10 wherein the step of sending the signal from the surface installation to the downhole electronics package further comprises sending an electromagnetic signal.

14. The method as recited in claim 10 wherein the step of establishing the communication path between the self-contained downhole hydraulic fluid source and the downhole device further comprises operating a valve from a closed position to an open position.

15. The method as recited in claim 10 wherein the step of actuating the downhole device further comprises setting the downhole device.

16. The method as recited in claim 15 wherein the downhole device is a packer assembly.

17. An apparatus for actuating a hydraulically controllable device disposed in a wellbore comprising:

a self-contained downhole hydraulic fluid source storing hydraulic fluid proximate the hydraulically controllable device;

a hydraulic fluid passageway providing a communication path between the self-contained downhole hydraulic fluid source and the hydraulically controllable device;

a valve disposed within the hydraulic fluid passageway; and a downhole electronics package receiving a signal from the surface to operate the valve from a closed position to an open position to allow transmission of the hydraulic fluid from the self-contained downhole hydraulic fluid source to the hydraulically controllable device by utilizing hydrostatic pressure from an annulus surrounding the hydraulically controllable device to urge the hydraulic fluid from the self-contained downhole hydraulic fluid source to the hydraulically controllable device and thereby actuating the hydraulically controllable device.

18. The apparatus as recited in claim 17 wherein the hydraulic fluid source further comprises a housing and a sleeve slidably disposed about the housing, the sleeve and the housing defining a hydraulic fluid chamber therebetween having the hydraulic fluid contained therein, the sleeve operating from a first position to a second position relative to the housing in response to hydrostatic pressure once the valve is operated from the closed position to the open position.

19. The apparatus as recited in claim 18 wherein the sleeve and the housing further define an air chamber therebetween having air contained therein.

20. The apparatus as recited in claim 17 wherein the downhole electronics package further comprises an acoustic transducer.

21. The apparatus as recited in claim 17 wherein the downhole electronics package further comprises a pressure pulse transducer.

22. The apparatus as recited in claim 17 wherein the downhole electronics package further comprises an electromagnetic transducer.

23. The apparatus as recited in claim 17 wherein the downhole electronics package further comprises a battery pack.

24. The apparatus as recited in claim 17 wherein the hydraulically controllable device is a packer assembly.

25. A well service apparatus comprising, in combination:

a hydraulically controllable device;

a self-contained downhole hydraulic fluid source operably associated with the hydraulically controllable device including a housing and a sleeve slidably disposed about the housing that define a hydraulic fluid chamber therebetween which initially contains a compressible fluid therein;

a hydraulic fluid passageway providing a communication path between the self-contained downhole hydraulic fluid source and the hydraulically controllable device;

a valve disposed within the hydraulic fluid passageway, the valve having open and closed positions; and a downhole electronics package receiving a signal from the surface to operate the valve from the closed position to the open position allowing the sleeve to operate from a first position to a second position relative to the housing in response to hydrostatic pressure from an annulus surrounding the well service apparatus such that the compressible fluid in the compressible fluid chamber is compressed to dampen the movement of the sleeve from the first to the second position and, simultaneously, the hydraulic fluid in the hydraulic fluid chamber is urged from the self-contained downhole hydraulic source to the hydraulically controllable device, thereby actuating the hydraulically controllable device.

26. The apparatus as recited in claim 25 wherein the downhole electronics package further comprises an acoustic transducer.

27. The apparatus as recited in claim 25 wherein the downhole electronics package further comprises a pressure pulse transducer.

28. The apparatus as recited in claim 25 wherein the downhole electronics package further comprises an electromagnetic transducer.

29. The apparatus as recited in claim 25 wherein the downhole electronics package further comprises a battery pack.

30. The apparatus as recited in claim 25 wherein the hydraulically controllable device is a packer assembly.

* * * * *